United States Patent [19]

Aviram et al.

[11] 4,268,368

[45] May 19, 1981

[54] ELECTROPHORETICAL METHOD FOR SELECTIVELY REINKING RESISTIVE RIBBON THERMAL TRANSFER PRINTING RIBBONS

[75] Inventors: Ari Aviram, Yorktown Heights; Keith S. Pennington, Somers, both of N.Y.; Lawrence Kuhn, Tucson, Ariz.

[73] Assignee: International Business Machines Corporation, Armonk, N.Y.

[21] Appl. No.: 133,152

[22] Filed: Mar. 24, 1980

[51] Int. Cl.[3] ..... C25D 13/06; C25D 13/16

[52] U.S. Cl. ..... 204/181 C

[58] Field of Search ..... 204/181 C

[56] References Cited

U.S. PATENT DOCUMENTS 3,539,489 11/1970 Ness ..... 204/181 C

*Primary Examiner*—Howard S. Williams

*Attorney, Agent, or Firm*—Sughrue, Rothwell, Mion, Zinn and Macpeak

[57] ABSTRACT

A method is described for selectively reinking a resistive ribbon thermal transfer printing ribbon, comprising:

(1) positioning a used resistive ribbon thermal transfer printing ribbon in a colloidal dispersion of electrophoretically depositable ink prepared (a) heating a water-insoluble polymeric binder having a melting point in the range of 85° C. to 100° C. until the polymeric binder has been melted to a liquid state, (b) adding and blending a pigment into the melted polymeric binder, (c) adding and blending a heated dilute, aqueous solution of a carboxylic acid to the composition formed in (b), and (d) adding and blending a colloid charge-forming compound to the composition formed in (c), to form an aqueous dispersion of a pigment-containing polymeric colloid, (e) cooling the dispersion formed in (d); and (2) passing an electric current through said colloidal dispersion, with an electrically conductive layer of said ribbon serving as one electrode, to electrophoretically deposit the pigment-containing polymeric colloid on areas of said ribbon that have been depleted of ink, to form a ink layer of uniform thickness.

10 Claims, 4 Drawing Figures

ELECTROPHORETICAL METHOD FOR SELECTIVELY REINKING RESISTIVE RIBBON THERMAL TRANSFER PRINTING RIBBONS

BACKGROUND OF THE INVENTION

Printing by means of the resistive ribbon thermal transfer technique is a desirable method of printing, having a number of advantages. In printing by resistive ribbon thermal transfer, an electrically resistive ribbon is pattern-wise heated by the passage of current through the ribbon. The operation of pattern-wise heating the ribbon melts neighboring regions of a layer of ink that forms one surface of the ribbon and renders it pattern-wise transferable while contacting the ink surface of the ribbon to the paper to be printed.

A resistive ribbon thermal transfer printing ribbon (also referred to herein as the "thermal transfer ribbon" or simply "ribbon") useful in such processes typically comprises three layers, viz.:

(1) a resistive film of polymeric material, such as a polycarbonate, containing conductive carbon particles;
(2) a thin metal layer, e.g., an evaporated aluminum film deposited upon the resistive film having a thickness of about 1,000 Å, and
(3) a fusible ink layer formed, e.g., from a polymeric material and carbon black.

Layer (2) may be omitted, but is preferred to achieve improved resolution.

When such a resistive thermal transfer ribbon is used for printing, the ink is transferred from the heated spots and transferred to the surface being printed. Due to the depletion of ink corresponding to the printed patterns made thereby, the ribbon can not be reused unless a uniform coating of a fusible ink is again formed on the surface of the ribbon. Processes for depositing a uniform thickness of ink over all regions of the ribbon would not be expected to be useful for such reinking, as the resulting ribbon would not have a uniform thickness of ink thereon.

A number of processes have been described in the prior art for reconditioning, e.g., typewriter ribbons. U.S. Pat. No. 2,051,942, issued Aug. 25, 1936 describes the total reinking of used typewriter ribbons with a composition based on coconut oil, and including also sulfuric acid, lamp black, and gum arabic; the composition is applied to the face of the used typewriter ribbon, and after allowing time for penetration into the pores of the typewriter ribbon, excess composition is removed, e.g., by scraping, from the face of the ribbon.

U.S. Pat. No. 2,155,653, issued Apr. 25, 1939, describes a method for redistributing ink from undepleted areas of a typewriter ribbon to the depleted areas to form a uniformly inked ribbon by means of treatment with hydrocarbon vapors. Of course this process could be used only a limited number of times because as the density of the redistributed ink becomes lower it would adversely affect the quality of the typed images formed using such a ribbon.

U.S. Pat. No. 3,105,769, issued Oct. 1, 1963, describes a liquid solution intended to soften and redistribute pigment remaining in a used typewriter ribbon (and the like) and to distribute "body" material included in the solution to the ribbon by means of capillary action.

Processes for coating small electrically conductive articles by electric deposition are known in the art, such as the process described in U.S. Pat. No. 3,539,489, issued Nov. 10, 1970.

SUMMARY OF THE INVENTION

According to the invention a method is provided for selectively reinking a resistive ribbon thermal transfer printing ribbon, comprising:

(1) positioning a used resistive ribbon thermal transfer printing ribbon in a colloidal dispersion of an electrophoretically depositable ink prepared by
  (a) heating a water-insoluble polymeric binder having a melting point in the range of 85° C. to 100° C. until the polymeric binder has been melted to a liquid state,
  (b) adding and blending a pigment into the melted polymeric binder,
  (c) adding and mixing a heated dilute aqueous solution of a carboxylic acid with the composition formed in (b), and
  (d) adding and blending a colloid charge-forming compound to the composition formed in (c), to form an aqueous dispersion of electrically-charged pigment-containing polymeric colloid,
  (e) cooling the colloidal dispersion formed in (d); and
(2) passing an electric current through said colloidal dispersion, with an electrically conductive layer of said ribbon serving as one electrode, to electrophoretically deposit the pigment-containing polymeric colloid on areas of said ribbon that have been depleted of ink, to form an ink layer of uniform thickness.

The present invention also relates to the electrophoretically depositable colloidal dispersion and its method of preparation.

DETAILED DESCRIPTION OF THE INVENTION

Figure 1:
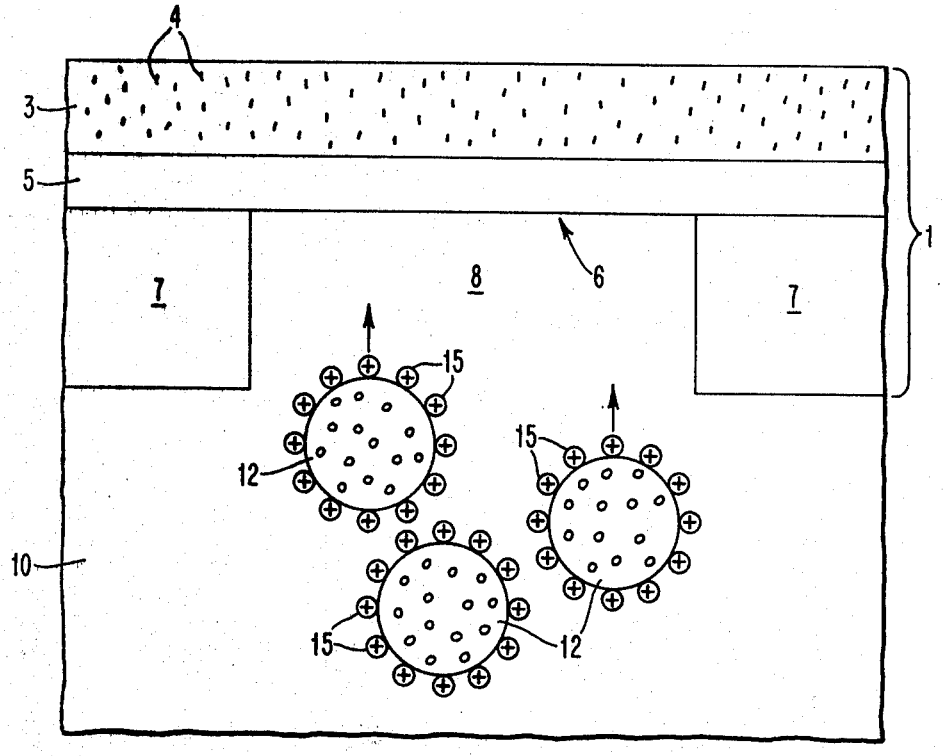
FIG. 1 illustrates in an expanded representation (not to scale) deposition of colloid particles onto the metallic substrate at an ink depleted area of a resistive ribbon thermal transfer printing ribbon according to the method of the invention.

The method of the invention utilizes a colloidal dispersion of electrophoretically depositable ink, viz., the pigment-containing polymeric colloid. This dispersion must have the property that when an electric current is passed therethrough, with the electrically conductive layer of the thermal transfer ribbon serving as one electrode, the colloid is selectively deposited in the areas of the ribbon that have been depleted of ink, to thereby form an ink layer of substantially uniform thickness, rendering the ribbon reuseable.

A colloidal dispersion useful in the method of the invention can be prepared according to the following steps. First, the polymeric binder is placed in a moderate or high-speed blender or other equipment used for preparing dispersions that is provided with a means for heating the container and melting the polymer. For instance, a moderate or high-speed blender containing an extra chamber, under and separated from the blending chamber, and with an inlet and outlet for a heating fluid (e.g., a boiling water/glycerol mixture at 105° C.), can be used; auxiliary heating means, such as a tape heater wrapped around the outside of the blender, can also be used. Extreme blending conditions, e.g., use of an ultra-high speed blend (≧1000 rpm), is generally not desirable, as extreme blending conditions may not result in a stable dispersion.

After melting the polymeric binder, a pigment is then added to and blended with the molten polymer until a homogeneous-appearing composition is formed.

Then a heated dilute carboxylic acid solution is added and vigorous mixing is commenced with continuous heating. The carboxylic acid solution is heated to a temperature such that it does not solidify the melted polymeric binder and permits mixing to take place; e.g., a 1% aqueous solution of acetic acid at its boiling point is useful. The heated carboxylic acid solution can be added in one or more steps. Water may be added to further dilute the acid solution.

Finally, the colloid charge-forming compound is introduced, with further blending, to form the final colloidal dispersion, which is then allowed to cool.

Water-insoluble fusible polymeric binders used in forming a colloidal dispersion according to the invention have melting points in the range of about 85° C. to 100° C. They may be of several types, including polyamides available under the trademark Versamide, acrylics available under the trademarks Rhoplex and Joncryl, and other polymeric binders, e.g., available under the trademarks Unirez, Staybelite, and Levisol provided that they possess the essential properties of being water-insoluble and having a melting point of 85° C. to 100° C.

Of course, the polymeric binder also has the property when adhered to the metal layer of a thermal transfer ribbon of being transferable and fusible to a paper being printed upon application of appropriate heat and pressure.

Pigments that may be used in forming the colloidal dispersions used in the method of the invention include not only finely-powdered solid pigments, such as those described in the *Colour Index,* 3rd Ed. 1971, published by the Society of Dyers and Colourists, Bradford, England, but also dyes used for pigmentation purposes. In printing operation the pigment is typically carbon black.

The aqueous carboxylic acid solution serves as the dispersing medium for the colloid. Any dilute solution of carboxylic acid, e.g., 10% or less by weight carboxylic acid, may be used. Preferably, the concentration of carboxylic acid is in the range of about 0.5 to 3 percent, e.g., 1%. Various carboxylic acids may be used, but it is preferred to use carboxylic acids having from one to four carbon atoms. Acetic acid is particularly preferred.

The colloid charge-forming compound is an ionizable compound which, under appropriate pH conditions, confers an electrical charge to the dispersed colloid particles, in order to render them mobile under the influence of an electric current so as to move in the direction of the ribbon electrode. Thus, when the ribbon is being used as the cathode, the colloid charge-forming compound must confer a positive charge on the colloid particles; in an acidic environment, i.e., pH<7, compounds such as aliphatic amines are useful in conferring a positive charge on the colloid particles. Conversely, if it is desired to use the ribbon as the anode, e.g., in embodiments wherein the resistive ribbon does not include a thin metal layer, the colloid charge-forming compound must confer a negative charge on the colloid particles; for example by adjusting the pH to >7 and then adding a fatty acid (e.g., stearic acid), a negatively-charged colloid can be obtained.

The aliphatic amine used in colloidal dispersions according to the invention serves to charge the dispersed particles positively presumably by adsorption to the surface of the pigment-containing polymeric colloid particles. Primary, secondary (N-substituted), and tertiary (N,N-substituted) aliphatic amines may be used in the method of the invention; aliphatic amines having from 12 to 30 carbon atoms are preferred, e.g., N,N-dimethyl octadecylamine.

In one method of the invention, a used thermal transfer ribbon is positioned in a colloidal dispersion of electrophoretically depositable ink according to the invention, and subjected to the passage of an electric current through the colloidal dispersion with the metallic layer of the ribbon serving as the cathode. This results in electrophoretic deposition of the pigment-containing polymeric colloid on areas of the ribbon that have been depleted of ink, such as by prior use of the ribbon for printing. The ribbon may either be stationary in or continuously moved through the colloidal dispersion, with continuous movement being preferred.

The metal layer of the thermal transfer ribbon is used as the cathode in this method of the invention in order to prevent corrosion of the metal layer, which would occur were it to be used as the anode with a negatively charged colloidal dispersion, by the anodization reaction $$M \rightarrow M^{n+} + ne^{-}.$$

Therefore the charge on the colloid dispersion of the ink in the method of the present invention is made positive when the thermal transfer ribbon includes a thin metal layer between the resistive film and the fusible ink layer, so that the colloid particles will migrate to the metal layer of the thermal transfer ribbon serving as the cathode. The positive charge is imparted to the colloid dispersion in the present invention by ammonium salts that are formed when the aliphatic amines specified according to the method are added to the aqueous carboxylic acid dispersion. It is believed, although applicants do not wish to be bound by this theoretical explanation, that the hydrocarbon chain portions of the aliphatic amine molecules are adsorbed on the spherical droplet particles of molten polymer, thus enveloping the droplet particles with positively charged ammonium ions.

The electrophoretically depositable inks of the invention can also contain minor amounts of additional components which do not adversely affect the basic properties of the inks. For instance, plasticizers, (e.g., butylcellosolve, or plasticizers sold under the trademark Santicizer) may be used in conjunction with the polymeric binder.

Also, a water-insoluble volatile organic component, e.g., kerosene, may be included in the ink. This component can be used in control of the final thickness of the deposited ink layer (by shrinkage of the layer as the volatile component evaporates), and, if used, is added to the molten polymer together with the pigment.

FIGS. 1-4 of the drawings illustrate features of the method of the invention.

FIG. 1 is an expanded representation illustrating the migration of colloid particles to the exposed metal surface of the used thermal transfer ribbon according to one method of the invention.

Particularly, the used thermal transfer ribbon 1, including a resistive substrate 3 containing conductive carbon particles 4, a thin metal layer 5 (preferably aluminum), and an ink layer 7 containing areas 8 depleted of ink, is immersed in an electrolytic cell containing the colloidal dispersion 10. The collodial dispersion 10 contains colloid particles 12, which are positively charged due to the action of the acidic dispersing medium on the aliphatic amines absorbed to the surfaces of the particles (resulting in formation of positively charged nitrogen atoms 15 at the amine sites). A voltage is applied to the cell from a power source (e.g., a Hewlett-Packard 6521A power supply, 0-1000 volts, 0-200 mA) such that the exposed metal surface 6 of the thermal transfer ribbon is negatively charged, and acts as the cathode of the cell. The positively charged colloidal particles 12 therefore migrate to the negatively charged exposed metal surface 6 and adhere thereto, to form a new layer of fusible ink in the depleted ink area 8.

Figure 2:
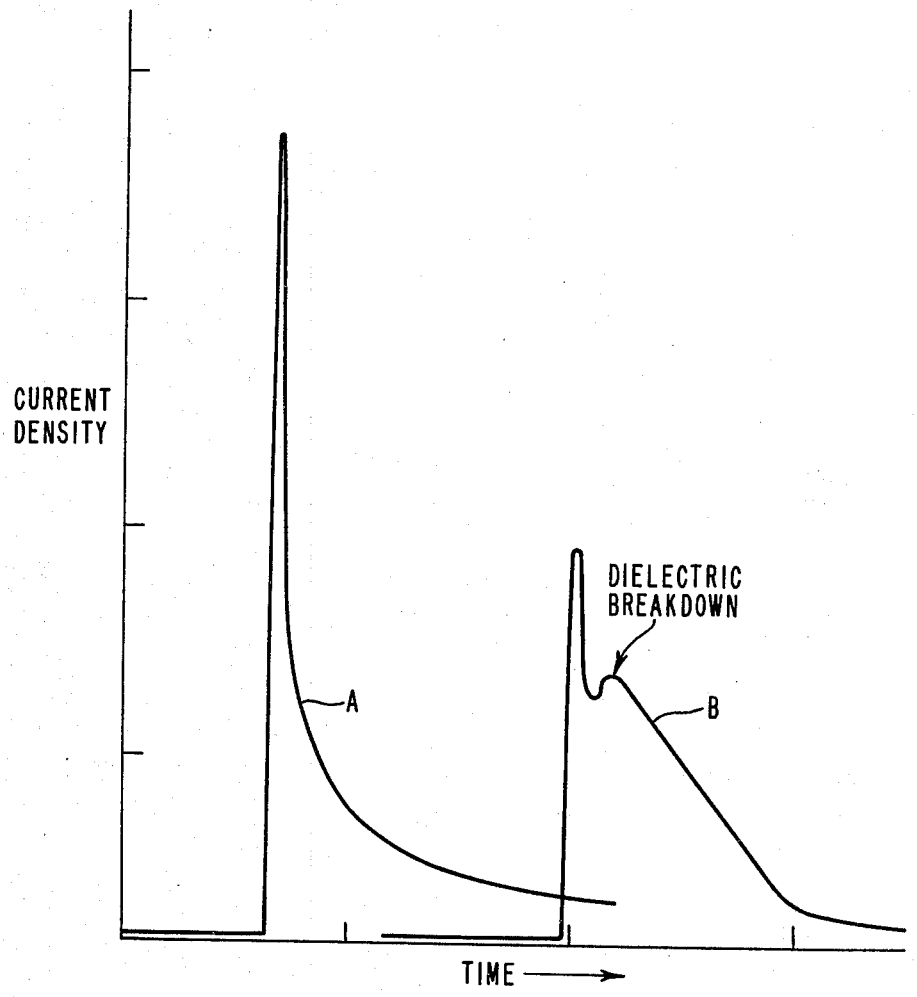
FIG. 2 illustrates the change in current density over time at a constant voltage for the method of the invention.

If deposition of the ink is allowed to proceed indefinitely, the rate of ink deposition decreases over time, until eventually a constant thickness is obtained. I.e., applying a constant voltage, the current density varies over a period of time, as shown in FIG. 2, (wherein curve A was obtained at a constant voltage of 135 volts, and curve B was obtained at a constant voltage of 202.5 volts) and both the current and the rate of ink deposition decrease as time passes, until by a self-limiting mechanism the ink layer matures to a final thickness between about 35 and 50 μm, the self-limiting state being reached in a period of 90 to 120 seconds. In general, the voltage may be varied between about 15 and 250 volts and although diectric breakdown may occur at higher voltages within this range (see FIG. 2) such occurrence does not appear to adversely affect the printing properties of the reinked ribbon.

Therefore in the method of the present invention, it is seen that the reinking can be controlled so that, by appropriate selection within the skill of the art of voltage, current, and time of immersion of the ribbon, the thickness of the newly deposited ink does not exceed the thickness of the layer of previously unused ink, typically about 5 μm.

Figure 3:
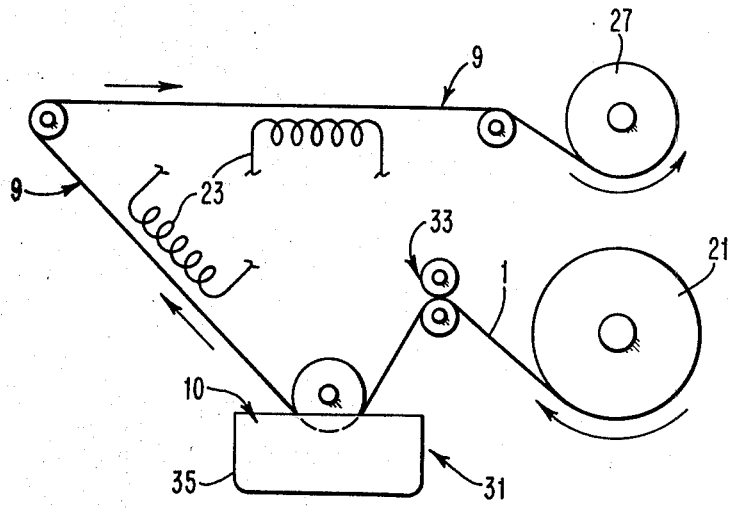
FIG. 3 illustrates a method and apparatus for continuous selective reinking of a used resistive ribbon thermal transfer printing ribbon according to the invention.
Figure 4:
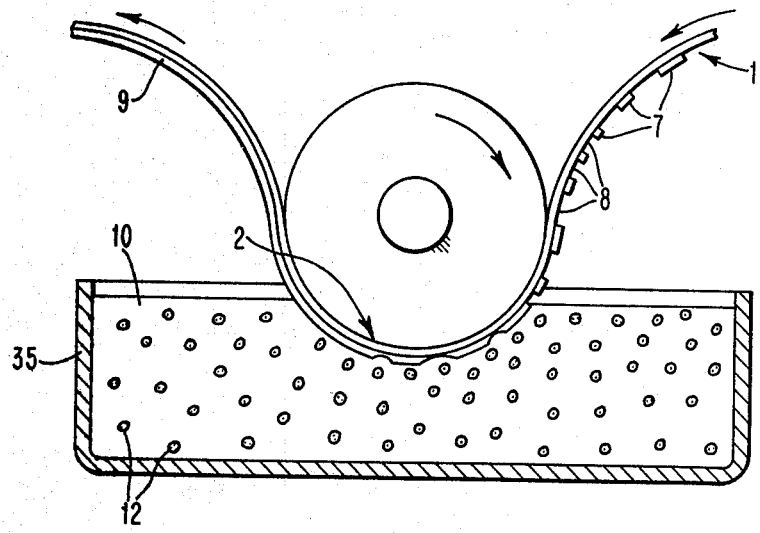
FIG. 4 shows an expanded (not to scale) view of the reinking method illustrated in FIG. 3, particularly depicting the reinking of the depleted ribbon as it passes through the colloidal dispersion.

The method of the invention can be practiced using the used thermal transfer ribbon as either a stationary cathode or a moving electrode, the latter being preferred, and particularly illustrated in FIGS. 3 and 4, which show the method being carried out with an apparatus for continuously supplying the ribbon to the electrolytic cell. In FIGS. 3 and 4, the used thermal transfer ribbon 1 is taken from a supply roll 21 to an electrolytic cell 31 containing the colloidal dispersion 10, where a source of negative voltage 33 first contacts the exposed conductive or resistive surface of the used thermal transfer ribbon. This negative voltage is transmitted to the portion 2 (see FIG. 4), e.g., ½ inch in length, of the ribbon immersed in the colloidal dispersion at any particular point in time; therefore the exposed metal surface of the ribbon serves as the cathode of the electrolytic cell, while, e.g., the vessel 35 containing the colloidal dispersion can serve as the anode of the electrolytic cell.

The ribbon passing through the cell is subject to the following mathematical relationships:

$$X\int_0^Y dy = XW\int_0^T dt \text{ and } A = XWT$$

where X is the ribbon width, Y is the ribbon length, W is the ribbon's velocity, T is the time that portion dy spends in the colloidial dispersion, and A is the area contacted with the colloidal dispersion; these relationships can be used in determining optimum operating parameters for particular embodiments of the method of the invention.

As the ribbon passes through the dispersion, it is reinked by deposition and adherence of the colloid particles to be exposed metal surface of the resistive ribbon cathode, to form a uniform reinked layer 9.

The reinked ribbon may be rinsed after emersion from the suspension (not shown), and air dried, or preferably is heater dried, such as by heating elements 23 as illustrated in FIG. 3, followed by take-up and storage on a reel 27 for future use. Alternatively, the ribbon can be dried by passing a uniform current through the resistive substrate by means of contacting strip electrodes, to thereby uniformly heat and dry the ribbon.

EXPERIMENTAL 10 grams of Versamide 871 (trademark), a polyamide polymeric binder, was melted in a blender (105° C.). Then 2.4 grams of carbon black was added to the melted polymeric binder and mixed with a spatula. The mixture was then blended at a speed of 500 rpm and a solution of 25 ml of boiling 1% acetic acid in water was slowly added to the blender while heating was continued. The blending was continued for 3 minutes, followed by the slow addition of 175 ml of 1% aqueous acetic acid solution. Blending was continued for an additional 3 minutes, followed by addition of 200 ml of water. At this point, 1 gram of N,N-dimethyl octadecylamine was added and blending was continued for an additional 5 minutes. The resulting colloidal dispersion of electrophoretically depositable ink was allowed to cool and the foam on the surface thereof allowed to settle before use thereof.

In order to test for electrophoretic deposition properties, the colloidal dispersion above was coated on, e.g., silver platinum, aluminized Mylar (trademark for polyethylene terephthalate film), or aluminized thermal transfer ribbon (with a polycarbonate support including graphite particles), and tested as described above.

A thin layer of fusible ink was deposited on the cathode surface in all cases within a very short time.

The following Table summarizes a number of colloidal dispersions within the scope of the invention which were found to be electrophoretically depositable in accordance with the invention.

TABLE

| COLLOIDAL DISPERSION INK NUMBER | POLYMERIC BINDER (VERSAMIDE 871) GM | ALIPHATIC AMINE /GM | ACETIC ACID SOLUTION ACETIC ACID ML | ACETIC ACID SOLUTION WATER ML | PIGMENT (CARBON BLANK) GM | OTHER |
|---|---|---|---|---|---|---|
| 100 | 20 | $C_{18}H_{37}N(CH_3)_2$/1 | 2 | 200 | 2.4 | — |

TABLE-continued

| COLLOIDAL DISPERSION INK NUMBER | POLYMERIC BINDER (VERSAMIDE 871) GM | ALIPHATIC AMINE /GM | ACETIC ACID SOLUTION ACETIC ACID ML | ACETIC ACID SOLUTION WATER ML | PIGMENT (CARBON BLANK) GM | OTHER |
|---|---|---|---|---|---|---|
| 200 | 20 | $C_{18}H_{37}N(CH_3)_2/1$ | 2 | 200 | 2.4 | — |
| 300 | 20 | $C_{18}H_{37}N(CH_3)_2/1$ | 2 | 200 | 2.4 | SANTICIZER 141 5% |
| 400 | 20 | $C_{18}H_{37}N(CH_3)_2/1$ | 2 | 200 | 2.4 | SANTICIZER 154 5% |
| 500 | 20 | $C_{18}H_{37}N(CH_3)_2/1$ | 2 | 200 | 2.4 | SANTICIZER 8 5% |
| 600 | 20 | $C_{18}H_{37}N(CH_3)_2/1$ | 2 | 200 | 2.4 | BUTYL-CELLOSOLVE 5% |
| 700 | 20 | $C_{18}H_{37}N(CH_3)_2/1$ | 1 | 200 | 2.4 | — |
| 800 | 20 | $C_{18}H_{37}N(CH_3)_2/1$ | 2 | 200 | 2.4 | — |
| 900 | 20 | $C_{18}H_{37}N(CH_3)_2/1$ | 2 | 200 | 2.4 | — |
| 1000 | 20 | $C_{22}H_{45}N(CH_3)_2/1$ | 2 | 200 | 2.4 | — |
| 1100 | 30 | $C_{14}H_{29}NHC_{14}H_{29}$ | 2 | 200 | 2.4 | — |
| 1200 | 20 | $C_{22}H_{45}N(CH_3)_2/1.5$ | 2 | 200 | 2.4 | — |
| 1300 | 20 | $C_{22}H_{45}N(CH_3)_2/2$ | 2 | 200 | 2.4 | — |
| 1400 | 10 | $C_{22}H_{45}N(CH_3)_2/1.5$ | 2 | 200 | 2.4 | — |
| 1500 | 15 | $C_{22}H_{45}N(CH_3)_2/1$ | 2 | 200 | 2.4 | — |
| 1600 | 20 | $C_{22}H_{45}N(CH_3)_2/1$ | 2 | 200 | 2.4 | kerosene 20 gm |
| 1700 | 20 | $C_{22}H_{45}N(CH_3)_2/1.5$ | 2 | 200 | 2.4 | — |

With respect to the foregoing Table, it is noted that Ink No. 200, containing the same components in the same amounts as Ink No. 100, was prepared to show the consistency of the method of preparation, and, similarly, Ink No. 900 was essentially a repeat of Ink No. 700, except that a new batch of Versamide 871 polymeric binder was used with substantially no change in the ability to electrophoretically deposit the ink. Ink Nos. 300, 400, 500 and 600 contained plasticizers as indicated, with substantially no change in the ability to electrophoretically deposit the ink. The inks exhibiting the most preferred properties were Ink Nos. 1300 and 1400. Ink No. 1700, which was identical to Ink No. 1200 in terms of the relative amounts of the components used, was mixed using an ultra high speed Super Dispaxed (trademark) blender at 1000 rpm; the ink exhibited undesired coagulation when prepared under such extreme bleding conditions.

It is to be understood that various changes and modifications can be made to the embodiments of the invention described above without departing from the spirit and scope of the invention.

What is claimed is:

1. A method for selectively reinking a resistive ribbon thermal transfer printing ribbon, comprising:

(1) positioning a used resistive ribbon thermal transfer printing ribbon in a colloidal dispersion of electrophoretically depositable ink, prepared by (a) heating a water-insoluble polymeric binder having a melting point in the range of 85° C. to 100° C. until the polymeric binder has been melted to a liquid state, (b) adding and blending a pigment into the melted polymeric binder, (c) adding and mixing a heated dilute aqueous solution of a carboxylic acid to the composition formed in (b), to adjust the pH and (d) adding and blending a colloid charge-forming compound to the pH adjusted composition formed in (c), to form an aqueous dispersion of electrically-charged pigment-containing polymeric colloid, (e) cooling the colloidal dispersion formed in (d); and (2) passing an electric current through said colloidal dispersion, with an electrically conductive layer of said ribbon serving as one electrode, to electrophoretically deposit the pigment-containing polymeric colloid on areas of said ribbon that have been depleted of ink, to form an ink layer of uniform thickness.

2. A method for selectively reinking a thermal transfer ribbon as in claim 1 wherein said charge-forming compound is an aliphatic amine which forms a positively-charged colloid, and said electrically conductive layer comprises a metal film serving as a cathode.

3. A method for selectively reinking a thermal transfer ribbon as in claim 2 wherein the aliphatic amine has from 12 to 30 carbon atoms.

4. A method for selectively reinking a thermal transfer ribbon as in claim 3 wherein the aliphatic amine is N, N-dimethyl octadecylamine.

5. A method for selectively reinking a thermal transfer ribbon as in claim 1 or 2 wherein said pigment is a finely powdered solid pigment.

6. A method for selectively reinking a thermal transfer ribbon as in claim 3 wherein said pigment is carbon black.

7. A method for selectively reinking a thermal transfer ribbon as in claim 1 or 2 wherein said polymeric binder is a polyamide or a polyacrylic.

8. A method for selectively reinking a thermal transfer ribbon as in claim 1 or 2 wherein the carboxylic acid has from one to four carbon atoms.

9. A method for selectively reinking a thermal transfer ribbon as in claim 6 wherein the carboxylic acid is acetic acid.

10. A method for selectively reinking a thermal transfer ribbon as in claim 1 or 2 wherein said ribbon is continuously moved through the colloidal dispersion during step (2).

* * * * *